US008096756B2

(12) United States Patent
Vo

(10) Patent No.: US 8,096,756 B2
(45) Date of Patent: Jan. 17, 2012

(54) APPARATUS AND METHOD FOR CONTROLLING A COMPRESSOR

(75) Inventor: Huu Duc Vo, Montreal (CA)

(73) Assignees: Pratt & Whitney Canada Corp., Longueuil, Quebec (CA); Polyvalor, Limited Partnership, Montreal, Quebec (CA)

( * ) Notice: Subject to any disclaimer, the term of this patent is extended or adjusted under 35 U.S.C. 154(b) by 603 days.

(21) Appl. No.: 12/261,151

(22) Filed: Oct. 30, 2008

(65) Prior Publication Data

US 2010/0040453 A1 Feb. 18, 2010

Related U.S. Application Data

(60) Provisional application No. 61/034,839, filed on Mar. 7, 2008.

(51) Int. Cl.
*F01D 11/08* (2006.01)
*F01D 5/20* (2006.01)

(52) U.S. Cl. ..... 415/173.3; 415/1

(58) Field of Classification Search ..... 415/173.3, 415/173.1, 1, 914; 137/2
See application file for complete search history.

(56) References Cited

U.S. PATENT DOCUMENTS

| | | | | |
|---|---|---|---|---|
| 7,275,013 | B1 | 9/2007 | Matlis | |
| 2009/0065064 | A1 * | 3/2009 | Morris et al. | 137/2 |
| 2010/0284795 | A1 * | 11/2010 | Wadia et al. | 415/173.1 |

FOREIGN PATENT DOCUMENTS

WO WO 2007/133239 A2 11/2007

* cited by examiner

*Primary Examiner* — Caridad Everhart
(74) *Attorney, Agent, or Firm* — Norton Rose OR LLP

(57) ABSTRACT

A compressor comprises a casing having an inner surface surrounding a rotor assembly, the rotor assembly having a plurality of circumferentially spaced radially outwardly extending rotor blades, each blade having leading and trailing edges and a tip, the compressor further comprising at least one plasma actuator for suppressing rotating stall inception of the compressor, the at least one plasma actuator being mounted adjacent to the blade tips.

5 Claims, 15 Drawing Sheets

APPARATUS AND METHOD FOR CONTROLLING A COMPRESSOR

CROSS-REFERENCE TO RELATED APPLICATIONS

This application claims the benefit of priority from U.S. Provisional Patent Application No. 61/034,839 entitled APPARATUS AND METHOD FOR CONTROLLING A COMPRESSOR filed on Mar. 7, 2008 which is incorporated herein by reference.

TECHNICAL FIELD

The technique described below generally relates to an apparatus and method for controlling a compressor of a gas turbine engine.

BACKGROUND OF THE ART

Engine surge is a major limiting factor in the operating envelope of aircraft gas turbine engines and is a concern in every new engine design. It can occur at critical operating regimes such as take-off, manoeuvres and engine acceleration. It is characterized by the asymmetric flow oscillations across the entire engine that lead to a sudden drop in engine power and engine damage the severity of which depends on the strength of the surge. Surge is a system instability associated with the interaction of the compressor with the combustor and turbine and is usually triggered by rotating stall. The severity of the rotating stall depends on the compressor. Rotating stall is a well known compressor aerodynamic instability that occurs as the mass flow through the compressor is decreased at a certain speed. It is characterized by the formation of a cell of axial velocity deficiency that rotates at a fraction of the compressor rotation speed and it usually results in a drop in compressor pressure rise. A common practice of incorporating a safety margin against rotating stall, such as casing treatment or active control using moveable inlet guide vanes, often prevents the compressor from operating at peak efficiency and peak pressure ratio. In another approach, micro injectors can be used to inject low mass flow jets into the compressors of gas turbine engines, however, the risk clogging and mechanical complexity are serious obstacles to practical implementation. Therefore, there is a need for an improved technique for suppressing rotating stall inception in a compressor of gas turbine engines.

SUMMARY OF THE DESCRIPTION

In accordance with one aspect there is provided a compressor which comprises a casing having an inner surface surrounding a rotor assembly, the rotor assembly having a plurality of circumferentially spaced radially outwardly extending rotor blades, each blade having leading and trailing edges and a tip, the compressor further comprising at least one plasma actuator for suppressing rotating stall inception of the compressor, the at least one plasma actuator being mounted adjacent to the blade tips.

In accordance with another aspect, there is a method provided for suppressing rotating stall inception of a compressor, the compressor including a casing having an inner surface surrounding a rotor assembly, the rotor assembly having a plurality of circumferentially spaced radially outwardly extending rotor blades, each blade having leading and trailing edges and a tip, the method comprising actuating at least one plasma actuator disposed circumferentially around the casing near the blade tips of the rotor assembly to induce axial flow acceleration within a tip clearance gap region of the rotor assembly.

In accordance with a further aspect, there is a method for suppressing rotating stall inception of a compressor, the compressor including a casing having an inner surface surrounding a rotor assembly, the rotor assembly having a plurality of circumferentially spaced radially outwardly extending rotor blades, each blade having leading and trailing edges and a tip, the method comprising actuating independent adjacent plasma actuator sections around the casing near the blade tips of the rotor assembly to induce circumferentially varying axial flow acceleration within a tip clearance gap region of the rotor assembly, thereby resulting in a circumferential perturbation in pressure rise around the compressor.

Further details of these and other aspects of the technique will be apparent from the detailed description and figures included below.

DESCRIPTION OF THE DRAWINGS

Reference is now made to the accompanying figures, in which:

FIG. 11*a* to 11*c* illustrate spike stall assessment for $E^3$ rotor B at a design speed without actuation, in which FIG. 11*a* shows pressure rise characteristics in which:

FIG. 11*a* is a graphical illustration showing pressure rise characteristics;

FIG. 11*b* is an illustration showing an assessment of leading edge (LE) spillage (spike criterion 1); and FIG. 11*c* is a graphical illustration showing assessment of trailing edge (TE) backflow (spike criterion 2);

FIGS. 12*a* to 12*c* illustrate actuation effectiveness at a design speed (rotor tip Mach 0.2), in which:

FIG. 12*a* is a graphical illustration showing pressure rise characteristics;

FIG. 12*b* is an illustration showing assessment of LE spillage (spike criterion 1); and FIG. 12*c* is a graphical illustration showing assessment of TE backflow (spike criterion 2);

FIGS. 13*a* to 13*c* illustrate actuation effectiveness at a higher speed (rotor tip Mach 0.5), which:

FIG. 13*a* is a graphical illustration of a pressure rise;

FIG. 13*b* is an illustration showing an assessment of LE spillage (spike criterion 1);

FIG. 13*c* is a graphical illustration showing an assessment of TE backflow (spike criterion 2);

DETAILED DESCRIPTION OF THE PREFERRED EMBODIMENTS

Figure 1:
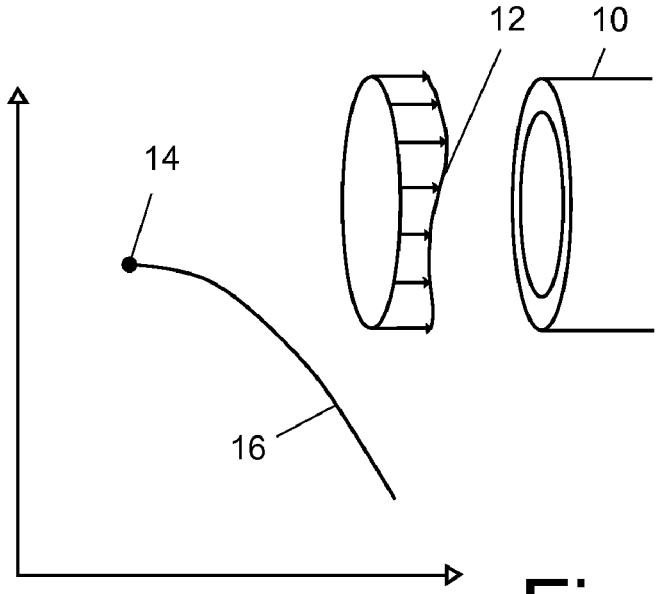
FIG. 1 is a schematic illustration of a long length-scale (modal) stall inception of a compressor.
Figure 2:
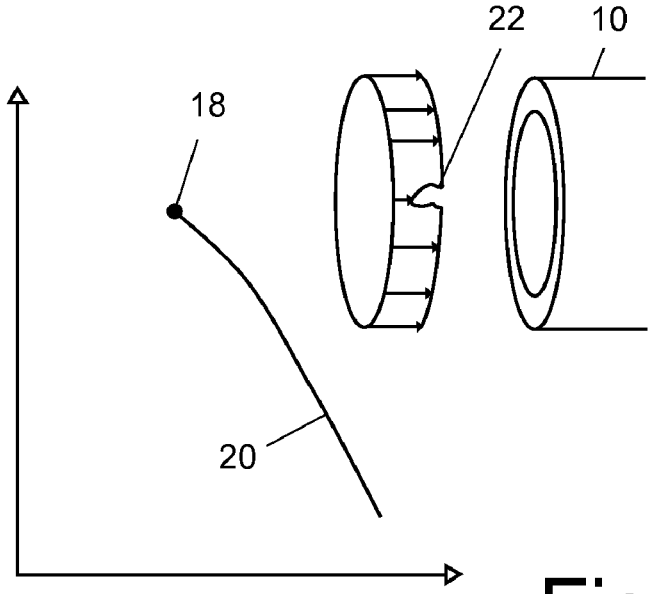
FIG. 2 is a schematic illustration of a short length-scale (spike) stall inception of a compressor.

In FIGS. 1 and 2, two routes to rotating stall have been identified in an axial compressor 10: a long length-scale (modal) and short length-scale (spike) stall inception. Modal stall inception as illustrated in FIG. 1, is characterized by a long length scale (modal) disturbance 12 of the axial mass flow velocity Vx. It is characterized by the evolution in tens of rotor revolutions of a small full-span disturbance of circumferential wavelength on the order of the annulus into a full rotating stall cell and has been shown to occur at, or slightly beyond, the zero-slope peak 14 of the stagnation-to-static pressure rise characteristics (speedline 16) of the compressor 10. It has been understood and successfully modeled. The associated physics can essentially be described as a growth of disturbances in the compression system as the damping goes from positive (negative speedline slope) to negative (positive speedline slope). The relatively slow growth rate and initial low amplitude of the modal disturbance means that its individual spatial (circumferential) harmonic can be by suppressed separately with low power actuation that introduces corresponding low-amplitude phase-shifted perturbations. This is the basis of previous successful active control of modal stall inception using movable inlet guide vanes, tip jet injection and full-span jet injection. The effectiveness of the actuators depends on how well they can produce the circumferential sinusoidal perturbation associated with each controlled harmonic, the amplitude of the perturbation they can produce and their bandwidth since the induced perturbations must rotate with the corresponding modal disturbance harmonics.

However, as illustrated in FIG. 2, many modern compressors stall at a negative slope 18 of the speedline 20, thus even before reaching the peak pressure rise associated with modal stall inception, instead exhibiting spike stall inception, as characterized by a short length-scale (spike) disturbance 22 of the axial mass flow velocity Vx. This other type of stall inception starts with the appearance of a sharp local disturbance (spike) at the rotor tip, only two to three blade passages in width, which grows into a fully developed rotating stall cell within roughly three rotor revolutions. The lack of understanding of spike stall inception, the localized nature of the disturbance and short time scales have traditionally made practical detection and active suppression very hard to achieve. A recent numerical study proposed a plausible mechanism to explain short length-scale rotating stall inception based in tip clearance flow.

Figure 3A:
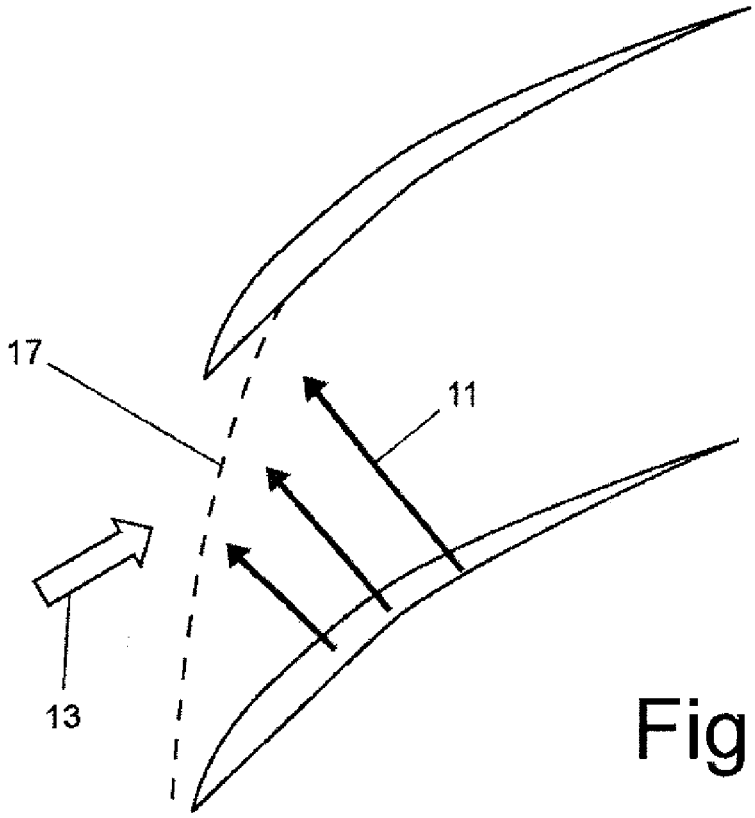
FIG. 3*a* is a top plan view in the tip region of two adjacent rotor blades of a rotor assembly of a compressor, showing an incoming/tip clearance flow interface.
Figure 3B:
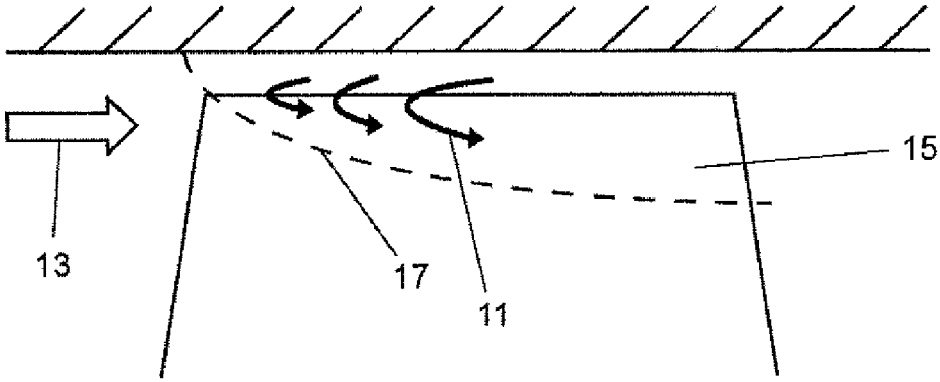
FIG. 3*b* is a partial cross-sectional view of the compressor of FIG. 3*a*, showing the same.

As illustrated in FIGS. 3*a* and 3*b*, tip clearance flow 11 is the flow through the clearance between the rotor blade tip and compressor casing, driven by the pressure difference across the rotor blade (blade loading). Due to the shear losses within and at the exit of the tip clearance, this fluid which comes out almost normal to the blade camber has high entropy. It then encounters the low-entropy incoming flow 13 to form an interface 17 that is defined by a region of high entropy gradient. The high-loss (low Pt) tip clearance fluid also forms a region 15 of low streamwise velocity that is equivalent to an aerodynamic blockage which reduces the pressure rise across the blade passage. The position of the incoming/tip clearance flow interface 17 results from a balance between the momentum of the incoming flow 13 and that of the tip clearance flow 11. As the flow coefficient decreases, the axial momentum of the incoming flow reduces. At the same time the blade loading and thus the tip clearance flow momentum increases resulting in a movement of the interface toward the rotor leading edge plane and the blockage in the tip region increases.

Figure 4A:
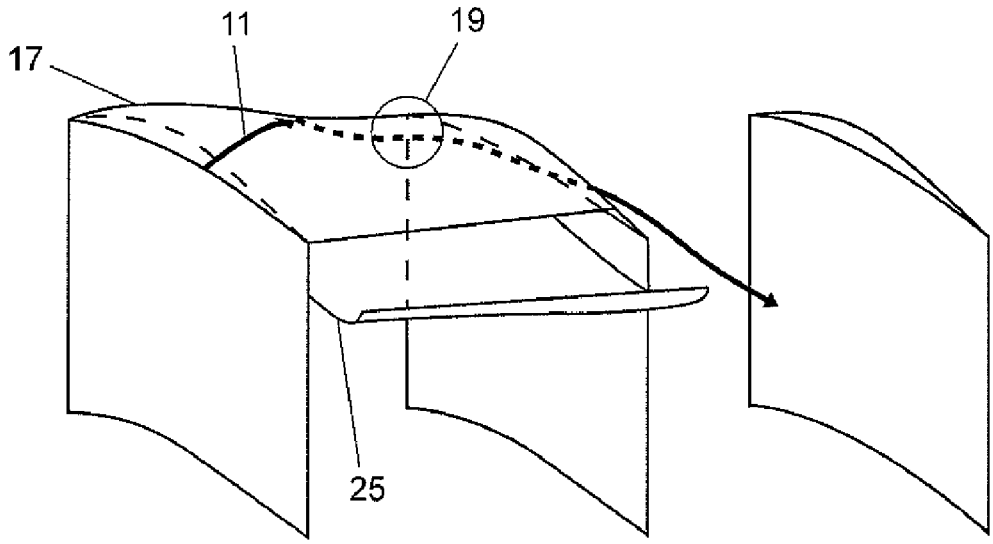
FIG. 4*a* is a perspective view of three adjacent rotor blades of a rotor assembly of a compressor, showing a leading edge tip clearance flow spillage below the blade tip (spike stall criterion 1)
Figure 4B:
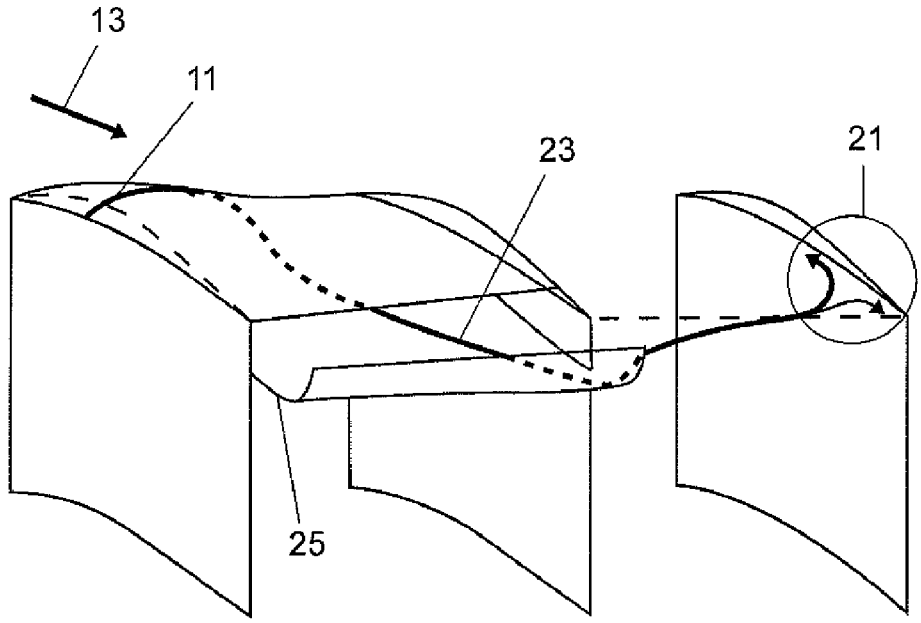
FIG. 4*b* is a perspective view similar to that of FIG. 4*a*, showing a backflow of tip clearance fluid below the trailing edge blade tip (spike stall criterion 2)

It is understood that two threshold flow events (and corresponding criteria) associated with tip clearance flow must be simultaneously present for spike disturbances to form and thus spike stall inception to occur. As illustrated in FIGS. 4*a* and 4*b* (numeral 25 indicates the edge of the tip clearance flow region), these are:

a) Tip clearance flow 11 spillage below the leading edge (LE) rotor blade tip 19 in FIG. 4*a*. The onset of this phenomenon is associated with the trajectory of the interface between the incoming and tip clearance flows lining up with the blade tip LE plane (spike stall criterion 1).

b) Axial flow reversal ("backflow") of tip clearance fluid 23 below the rotor trailing edge (TE) blade tip impinging on the pressure surface of the adjacent blade (indicated by numeral 21 in FIG. 4*b*). This event is indicated by negative pitch-averaged axial velocity (i.e. axially upstream flow) below the TE blade tip (spike stall criterion 2).

Figure 5:
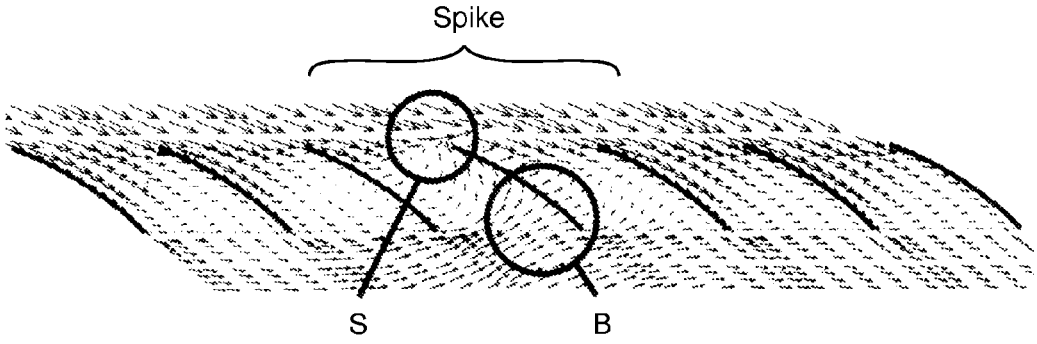
FIG. 5 is a schematic illustration of a spike disturbance formation and associated criteria, at the blade tip span at a time instant during a spike stall inception in a multiple blade passage Computational Fluid Dynamics (CFD) simulation.

The important point to note is that the above criteria for spike stall inception can be evaluated with single blade passage computations. The converged flow solution limit (equilibrium flow limit) in single passage simulations due to the proposed criteria does indeed lead in equivalent multiple blade passage simulations to the formation and growth of spike disturbances, as shown in FIG. 5 for a time instant during this process. The tip clearance fluid spillage can be observed in area S and the backflow can be observed in area B. The flow behavior in FIG. 5 has been experimentally measured on three low-speed single stage axial compressors and a computational study for a transonic rotor also support the proposed spike formation criteria. Two important implications for the prediction and suppression of spike stall inception are:

i) Single blade passage CFD (Computational Fluid Dynamics) simulations could be used to predict spike stall inception.

ii) Any technique that delays one of the two criteria for spike formation will suppress spike stall inception.

The first statement means that low-cost single blade passage CFD simulations could be used to evaluate and optimize the effectiveness of flow control strategies for suppressing spike stall inception before experiments are done. The second statement implies that relatively low-power actuation aimed exclusively at the rotor tip region should be sufficient in suppressing spike stall inception by providing the extra incoming flow momentum needed to at least delay the leading edge spillage of the tip clearance flow (spike stall criterion 1).

Figure 6A:
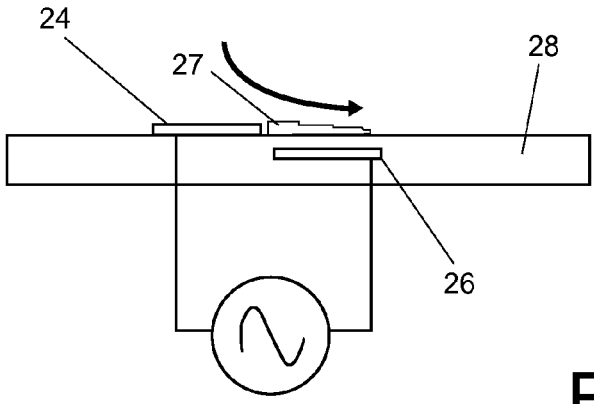
FIG. 6*a* is a schematic illustration of a plasma actuator.

Single dielectric barrier discharge (SDBD) plasma actuators may be advantageously used to suppress spike rotating stall inception. As shown in FIG. 6*a*, an SDBD actuator essentially consists of two offset thin electrodes 24 and 26, one of which is exposed to the air, and the other encapsulated in a dielectric material 28. When an AC voltage, for example, of several kilovolts at a frequency, for example, of several kilohertz is applied, weakly ionized gases 27 (plasma) are cyclically generated over the encapsulated (hidden) electrode 26. This plasma generation process does not involve any significant heating of the air and is sustainable at atmospheric pressure. The ionized air is subjected to an electric force in the presence of the electric field created by the electrodes. The result is an induced body force on the rest of the air in this region, which creates a very thin jet adjacent to the surface. The SDBD actuators and the plasma generation and momentum induction process during the voltage input cycle are known in the prior art.

Applications of plasma actuators for flow control have been growing in the past few years. These actuators have been tested in flows with Reynolds numbers up to the $10^5$ range to suppress boundary layer separation on airfoils and diffuser walls and to alleviate turbine aerodynamic losses using actuators mounted on the blade tip to effectively reduce the tip clearance gap. Plasma actuators have also been applied at much higher flow velocity to influence boundary layer instabilities on a sharp cone at Mach 3.5.

Figure 6B:
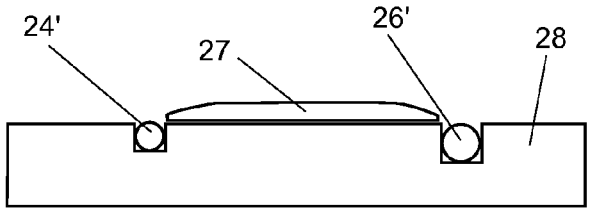
FIG. 6*b* is schematic illustration of another plasma actuator.

Alternatively, the SDBD plasma actuators may be replaced with dielectric barrier discharge (DBD) plasma actuators which are similar to SDBD plasma actuators, but with more than one dielectric barrier. Also alternatively, surface corona discharge plasma actuators as shown in FIG. 6*b* may be used in place of SDBD plasma actuators. Electrode 26' as a cathode has a diameter greater than electrode 24' as an anode.

Figure 7A:
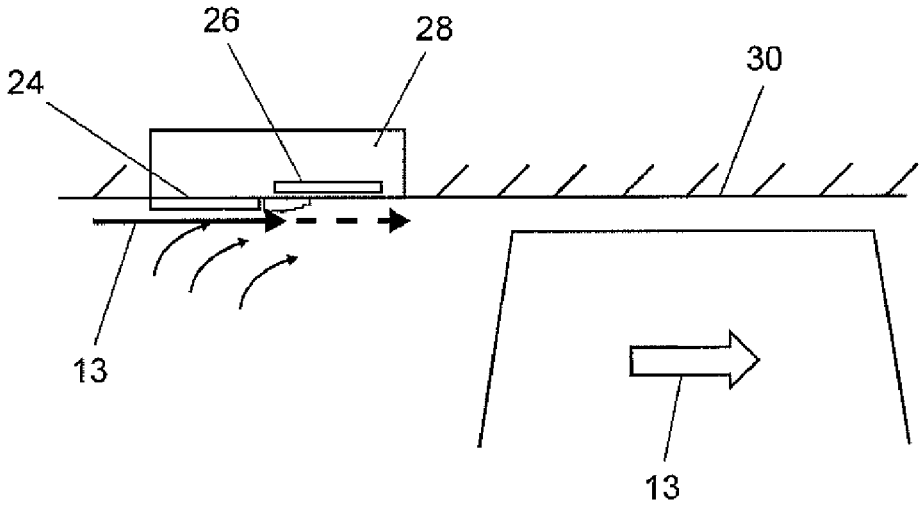
FIG. 7*a* is a partial cross-sectional view of a compressor having a plasma actuator, showing the concept of plasma flow actuation for suppression of rotating stall inception.
Figure 7B:
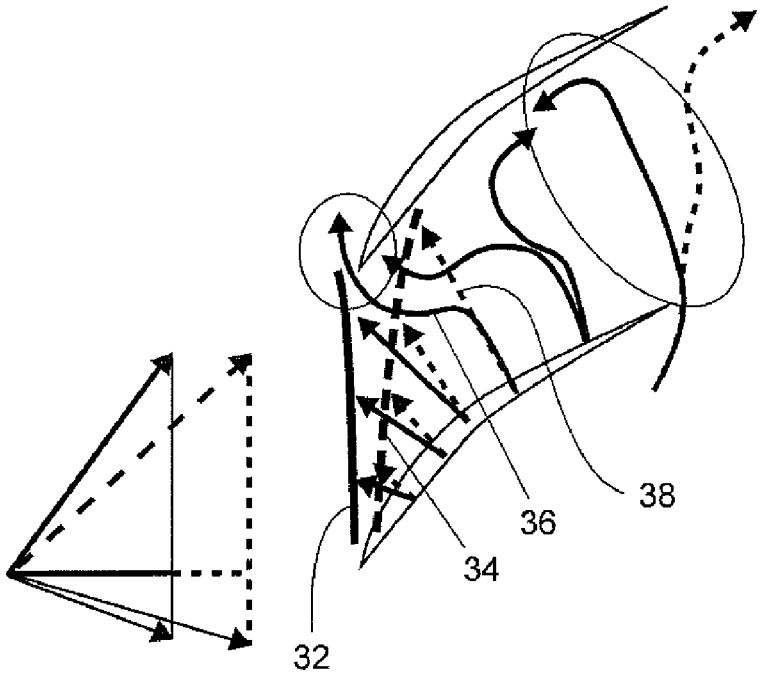
FIG. 7*b* is a top plan view in the tip region of two adjacent rotor blades of the compressor of FIG. 7*a*, showing changes of incoming/tip clearance flow interface, caused by the plasma flow actuation.

Based on the flow physics associated with rotating stall inception, plasma actuators may be used on the casing to suppress stall inception. FIGS. 7*a* and 7*b* show the proposed layout according to one embodiment which consists of two stationary thin annular (full-circumference) electrodes 24, 26 with the dielectric material 28 mounted on a casing 30 near the rotor. The first application would be to suppress spike stall inception, as depicted in FIGS. 7*a* and 7*b*. The increase in axial velocity ΔVx induced by the plasma actuator implies added momentum to the incoming flow 13 in the tip region. Since the trajectory of the interface 32 between the incoming and tip clearance flows is determined by the balance between their momentums, as explained for the interface 17 in FIG. 3*a*, the proposed actuation should move this interface 32 downstream of the leading edge plane as shown by broken line 34, and thus suppress spillage of tip clearance flow below the leading edge blade tip (spike criterion 1). In FIG. 7*b*, arrows 36 in solid lines show the tip clearance flow when the actuation is absent and arrows 38 in broken lines show the tip clearance flow when the induced axial flow acceleration ΔVx from plasma actuation is present. Moreover, there may also be a positive effect on tip clearance backflow below the trailing edge blade tip (spike criterion 2). According to the projected effect on the velocity triangles depicted in FIG. 7*b*, it is noted that the effect of actuation should be kept within the tip clearance flow region so as not to reduce the tip incidence and thus tip blade loading, which could negatively affect the stage pressure rise. Furthermore, if the proposed casing plasma actuator can induce a noticeable effect on the pressure rise characteristics, modifications can be proposed for its use to also suppress modal stall inception.

The time-averaged spatial body force distribution approach provides the most effective modelling of plasma actuation for flow control in complex internal flow problems as it captures the net spatial effect of the actuation on the flow near surface boundaries without adding much computational cost. A proposed approach consists of using a more accurate representative spatial body force distribution and scaling it to assess the effectiveness of plasma actuation with respect to total induced body force (rather than input voltage and frequency), starting from the body force level measured for conventional SDBD plasma actuators.

Figure 8A:
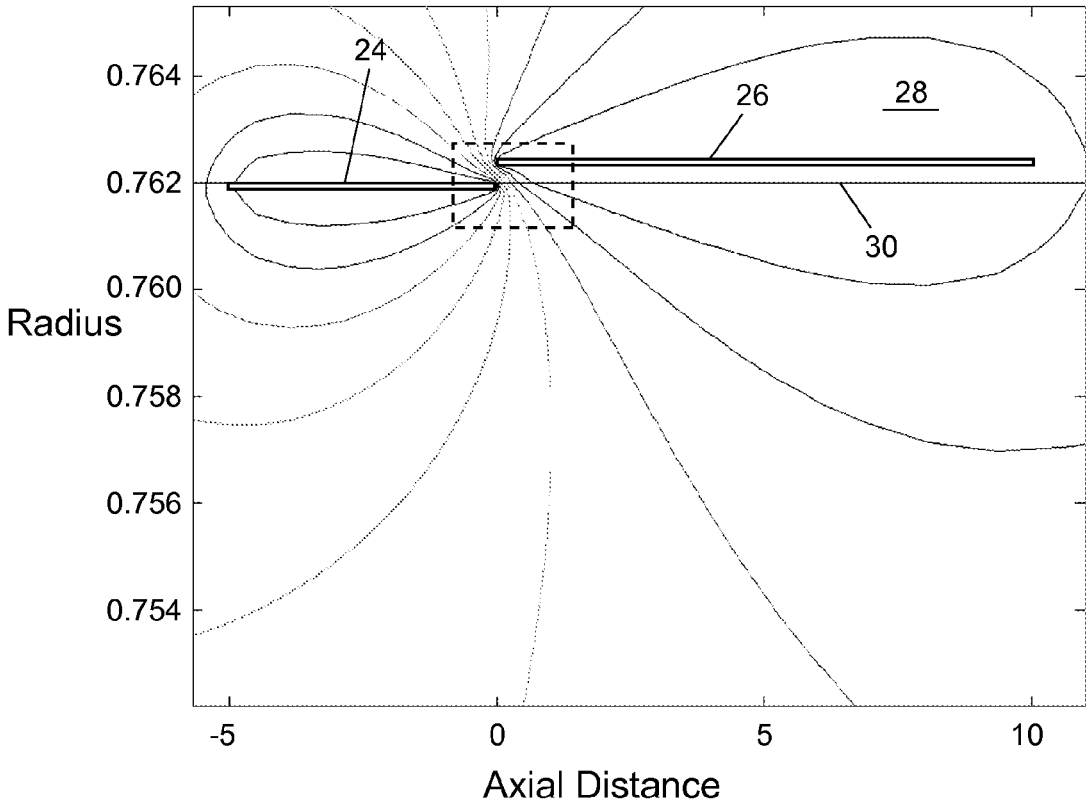
FIG. 8*a* is a schematic illustration of a representative Single Dielectric Barrier Discharge (SDBD) plasma actuator chosen for an actuator model in a computational approach and the associated modeled electric field.
Figure 8B:
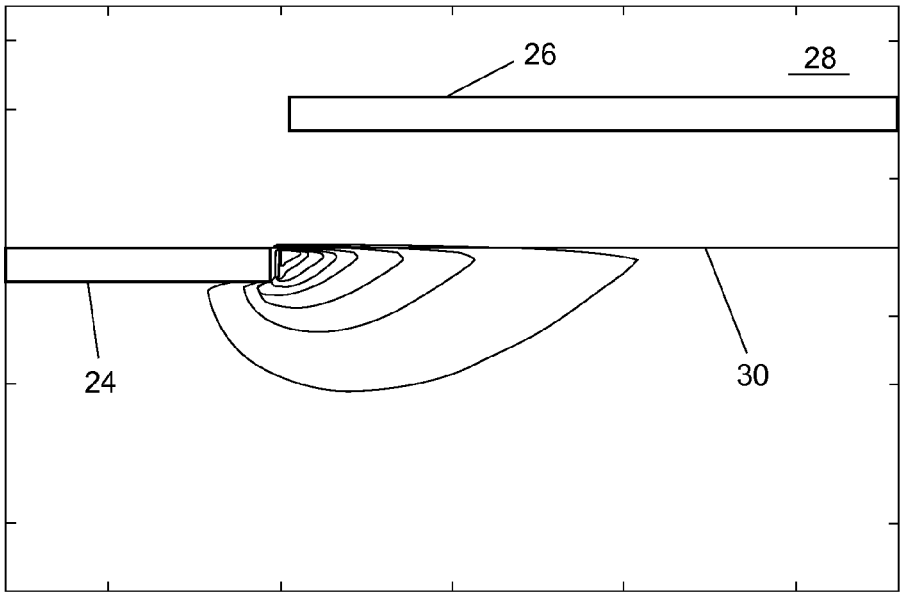
FIGS. 8*b* and 8*c* are schematic illustrations of the respective body force distribution and body force vectors of the SDBD plasma actuator of FIG. 8*a;*
Figure 8C:
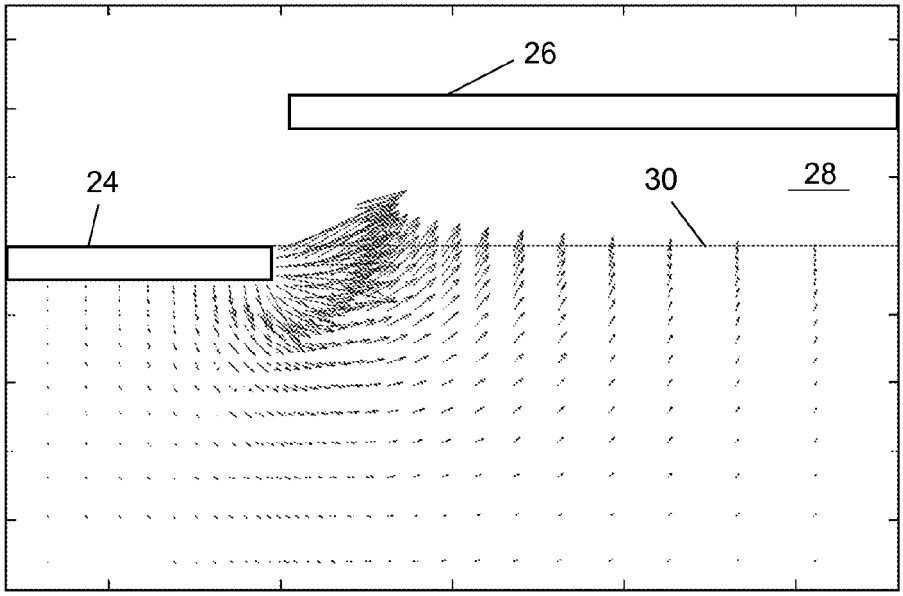

Among the plasma actuators models of average complexity capable of producing a body force distribution, one gives the spatial body force distribution that most resembles those simulated with the most sophisticated models. This model was thus used to obtain the representative time-averaged spatial body force distribution. The associated equations for the electrical potential and charge distributions were discretized in cell-centered form in cylindrical coordinates. They are solved on a fine mesh for an annular plasma actuator on a surface with the casing radius of the compressor geometry to be simulated. Two empirical parameters are needed by the model: the Debye length and the maximum charge density. Using the model's suggested Debye length of 0.001 m, the maximum charge density is obtained by calibrating the model so that it gives a total time-averaged streamwise body force for a similar actuator with a similar input voltage. This value comes out to be about 0.004 $C/m^3$, which is in the range of values obtained from simulations with a more sophisticated model. A representative SDBD plasma actuator is then chosen. As shown in FIG. 8*a*, it is composed of two 0.1 mm thick electrodes, 5 mm wide for the exposed electrode 24 and 10 mm wide for the encapsulated electrode 26 separated by a Kapton dielectric 28 thickness of 0.34 mm and an axial gap of 0.05 mm. FIG. 8*a* shows the electric potential field solved with the model, which is used with the computed spatial charge distribution (not shown), to give the spatial body force magnitude distribution and corresponding body force vectors. These two representations of the spatial body force distribution are presented in FIGS. 8*b* and 8*c* for the area delimited by the dashed lines in FIG. 8*a*.

According to the chosen model, this actuator should induce a time-averaged total axial body force of about 15 mN/m (milli-Newtons per meter of actuator length in the circumferential direction) for an input sinusoidal voltage amplitude of 10 kV, which is in the range of conventional SDBD plasma. With the chosen thickness of Kapton (dielectric), the voltage amplitude could in theory be increased by increasing the voltage and varying the input frequency. This representative body force distribution is thus scaled to obtain the total time-averaged induced axial body forces of 15, 76, 153 and 305 mN/m (also referred to in this work as actuator strength).

Figure 9:
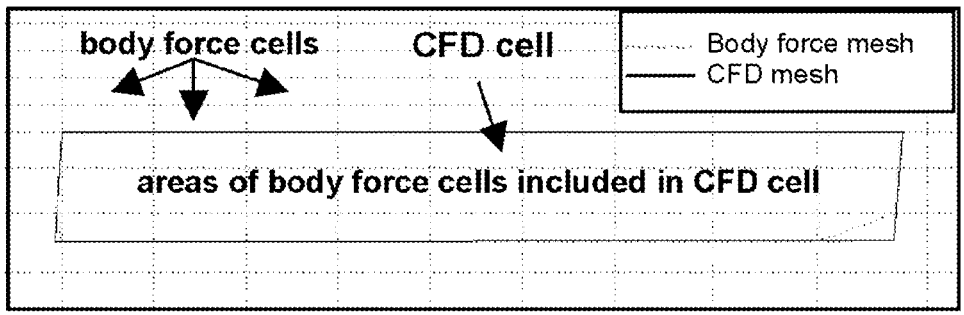
FIG. 9 illustrates determination of body forces for the CFD mesh.

The CFD code used for this embodiment is UNSTREST, a cell-centered 3-D RANS time-accurate turbomachinery CFD code with a mixing length turbulence model. Since the body force distribution is resolved on a finer mesh than the CFD mesh, the computed spatial body force distribution is transferred to the CFD mesh by superposing the two grids in the axial-radial plane according to the procedure illustrated in FIG. 9. Each (larger) cell of the CFD grid is placed on top of the body force grid and the body force associated with the CFD cell is the sum of those from the fine-mesh cells it incorporates, modulated by the percentage of the area of each small cell that lies in the CFD cell. The final body force (per unit depth in the circumferential direction) thus obtained is multiplied by the effective depth of each cylindrical cell (volume/side area) to obtain the total body force for each CFD control volume.

The rotor geometry on which to evaluate the proposed concept is the $E^3$ Rotor B, the first rotor of a GE low-speed constant radii four-stage research compressor with inlet guide vanes. This compressor has been shown experimentally to stall via spikes originating in the first rotor. This rotor geometry is representative of modern subsonic compressor blading. It has 54 blades with a mid-span solidity of 1.16. The hub-to-tip ratio is 0.85 with a constant casing radius of 762 mm. The design speed is 860 rpm, giving a tip Mach number of 0.2 and the Reynolds number based on tip chord is on the order of 300,000. This geometry can also be simulated at 2,150 rpm for a tip Mach number of 0.5. This is the rotor geometry used in the prior art to elucidate the mechanism of spike formation.

Figure 10A:
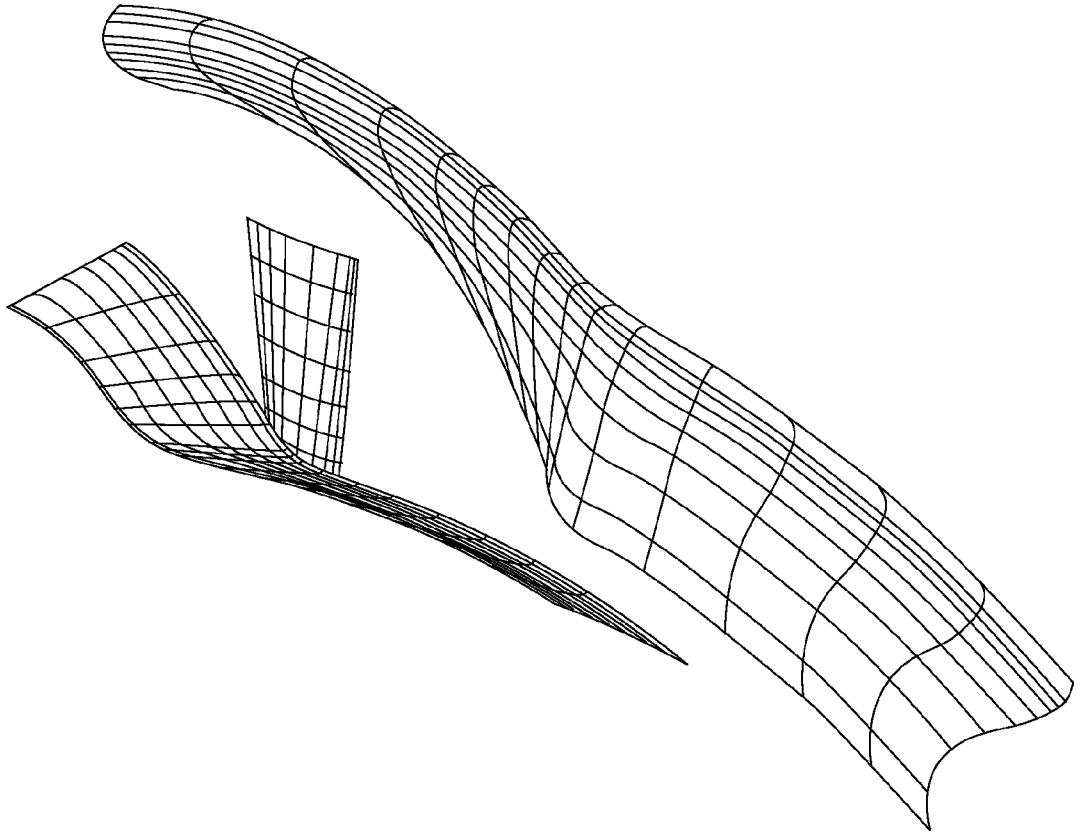
FIG. 10*a* is a partial three dimensional view of a compressor rotor geometry on which the present technique is evaluated, as well as the CFD mesh used for simulation.
Figure 10B:
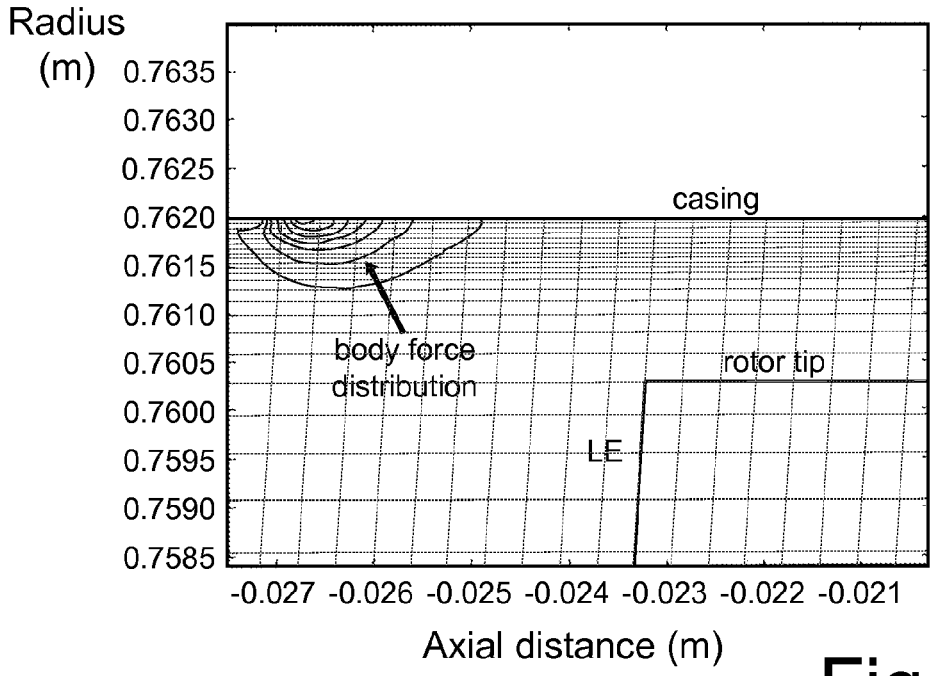
FIG. 10*b* is a partial schematic cross-sectional view of the compressor rotor of FIG. 10*a*, showing the body force distribution in the leading edge tip region of the compressor rotor.

FIG. 10*a* shows a 3-D view of the 136×41×45 structured mesh implemented in UNSTREST for time-accurate single blade passage simulation of the $E^3$ Rotor B. A pinched blade tip mesh is used. FIG. 10*b* gives a side view of the axial and radial grid near the LE tip clearance gap, with the associated body force distribution shown in FIG. 8*b* transferred to the CFD grid using the procedure illustrated in FIG. 9. The nominal tip clearance chosen for this embodiment of 1.7 mm (1.8% of tip chord) is shown. To better resolve the effect of actuation, a relatively fine axial and radial CFD grid is used over and downstream of the actuator location. On the other hand, since this is a tip critical rotor, a coarser radial mesh can be used at the hub whose boundary layer need not be resolved in this embodiment. The effect of the small thickness of the exposed electrode on the flow field is neglected and the small protrusion is thus not implemented in the CFD simulation.

Constant inlet stagnation pressure and temperature, as well as a radial distribution of the swirl angle are prescribed at the inlet. The pitch-averaged swirl angle distribution is obtained from the exit flow angle of the inlet guide vanes upstream of this rotor. The exit boundary conditions consist of a constant tip static pressure and radial equilibrium. Accordingly, an inlet duct axial length of one blade pitch is provided to let circumferential potential disturbances on the length-scale of the blade pitch decay to zero at the inlet plane. An exit duct of six blade pitches in axial length is provided to insure that any axially reversed flow at the trailing edge casing due to tip clearance backflow (as depicted in FIG. 4*b*) gets fully mixed out before reaching the exit plane. The set exit static pressure boundary condition also implies that the simulations can not capture stable points which lie at a lower mass flow that the point of exit static pressure turnover (zero-slope peak in stagnation-to-static pressure rise characteristics, associated with modal stall inception).

At the first rotor LE on the $E^3$ compressor, even at the (low) design speed, the Reynolds number should already be on the order of the transition value for clean flow. Combined with the presence of the upstream inlet guide vanes, a turbulent casing boundary layer can safely be assumed at the actuator location. Thus a turbulent casing boundary layer is implemented in the simulations.

For each compressor speed under study, the first step of the computational simulation is to find the equilibrium flow (converged solution) limit of the rotor (without actuation) and insure that it is the predicted spike stall inception point through the fulfilment of the two criteria for spike formation depicted in FIGS. 4*a* and 4*b*. Starting from a converged solution at high flow coefficient (low pressure rise), the exit tip pressure is increased to obtain a new equilibrium (converged) flow solution (in time-accurate mode). This exit tip pressure is increased incrementally until an equilibrium flow solution no longer exists. This last increment is reduced to get the last converged flow solution close to the equilibrium flow limit.

For the simulation with plasma actuation, the optimum actuator location may be near the rotor leading edge, according to one embodiment. Thus, the nominal actuator location is set at, for example, 7% of axial chord upstream of the tip leading edge, for which the body force distribution is shown in FIG. 10*b*. The actuator location is defined here by the axial position of the axial mid-gap between the two electrodes. The main intended effect of the actuator location at the leading edge is to move the incoming/tip clearance flow interface downstream (back into the blade passage) and thus delay the onset of leading edge tip clearance flow spillage (spike criterion 1). In addition, the effect of trailing edge actuation will also be verified with the actuator placed inside the blade passage at 7% axial chord upstream of the rotor trailing edge, according to another embodiment. The projected effect is to delay the onset of backflow below the blade tip at the trailing edge (spike criterion 2).

Simulations with plasma actuation are first carried out at design speed (860 rpm) with a tip Mach number of 0.2. At the exit pressure corresponding to last stable point of the reference (no actuation) case, actuation with induced time-averaged total axial body forces of 15, 76 and 153 mN/m are applied at the actuator location near the leading edge to assess its effects on the two spike stall criteria and pressure rise characteristics. Subsequently, the most effective actuator strength is applied to the location near the trailing edge for comparison. An optimum actuator location is chosen and the exit static pressure is increased to extend the speedline and evaluate how far the predicted stalled point can be delayed.

Thereafter, the above simulations are performed for the same compressor at 2.5 times the design speed for a tip Mach number of 0.5. The goal is to assess the change of actuation effectiveness to get a better idea of the actuation requirements for more realistic compressor speeds. In this higher speed case, the tip clearance has to be slightly reduced from 1.8% to 1.5% of chord to get the spike formation criteria to occur prior to the exit static pressure turnover (zero-slope peak of stagnation to static speedline) and thus be captured by the present simulations. Only the optimum actuator location is simulated, with actuator strengths of 76, 153 and 305 mN/m.

Figure 11A:
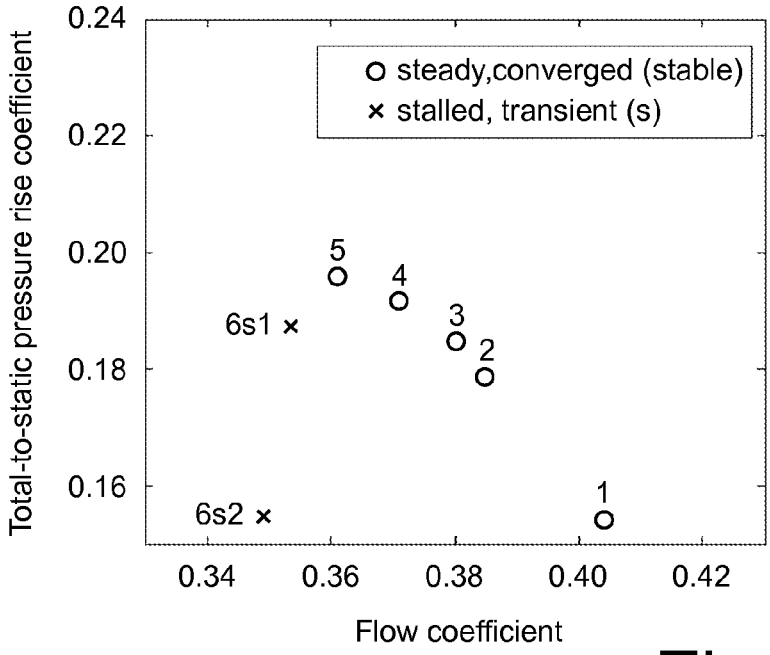
Figure 11B:
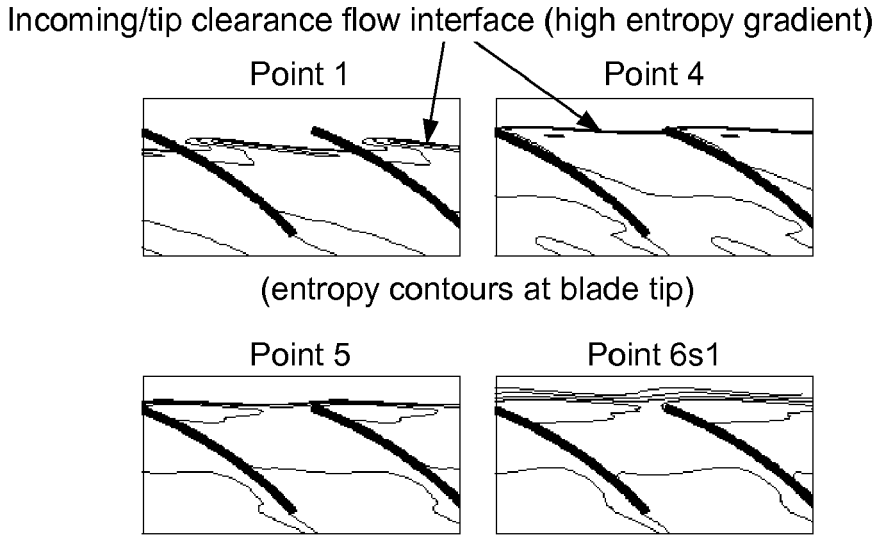
Figure 11C:
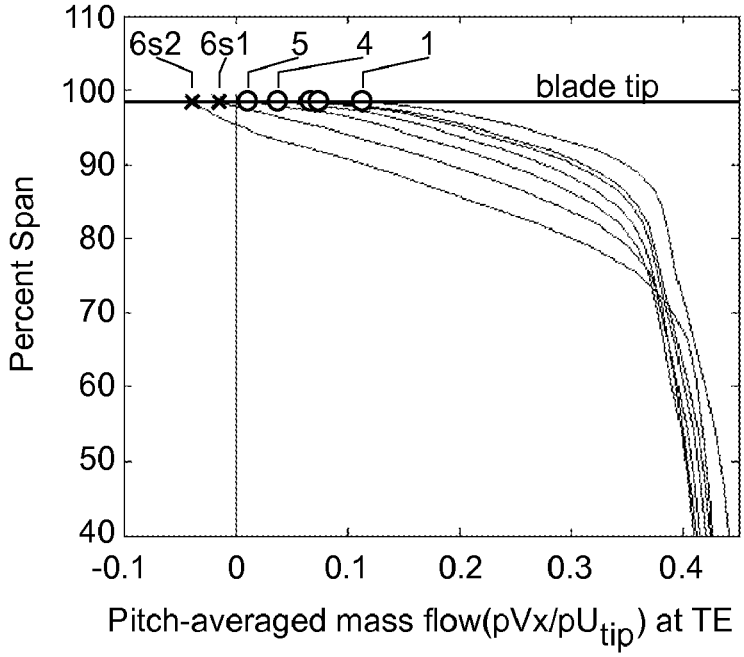
Figure 12A:
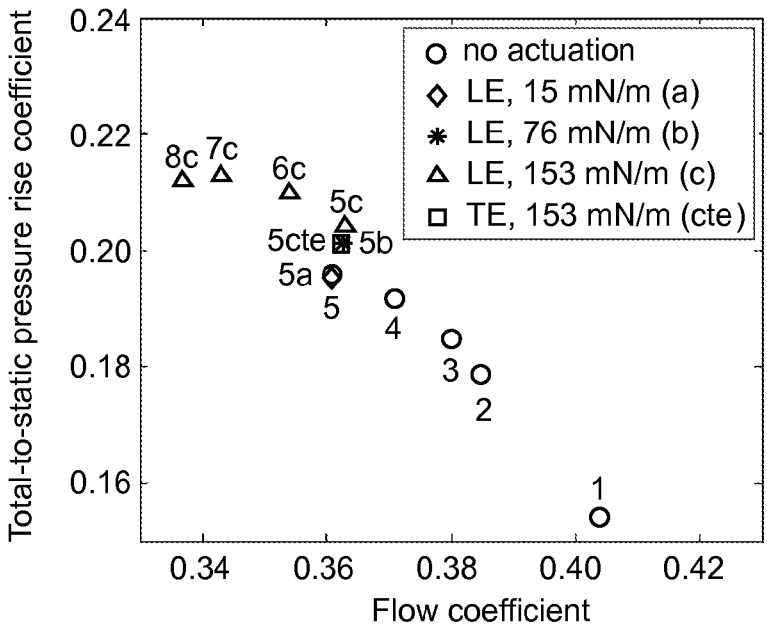
Figure 12B:
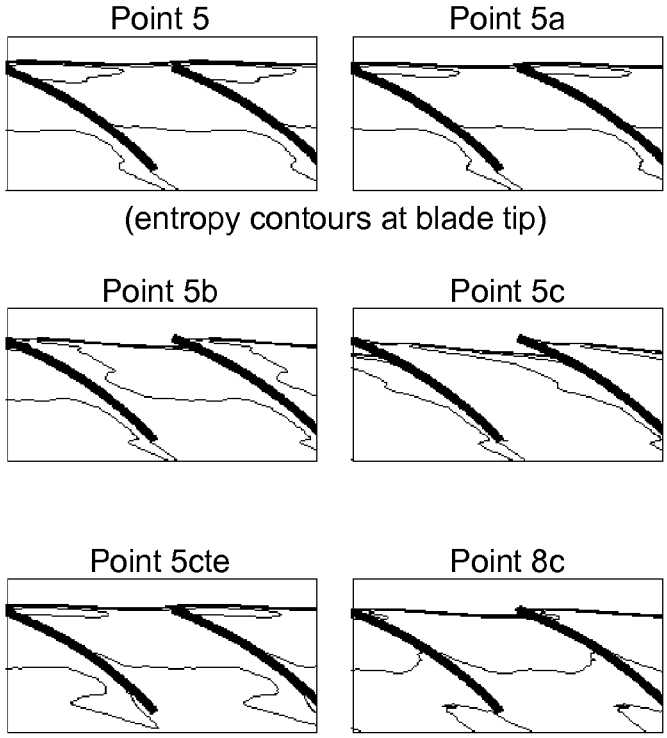
Figure 12C:
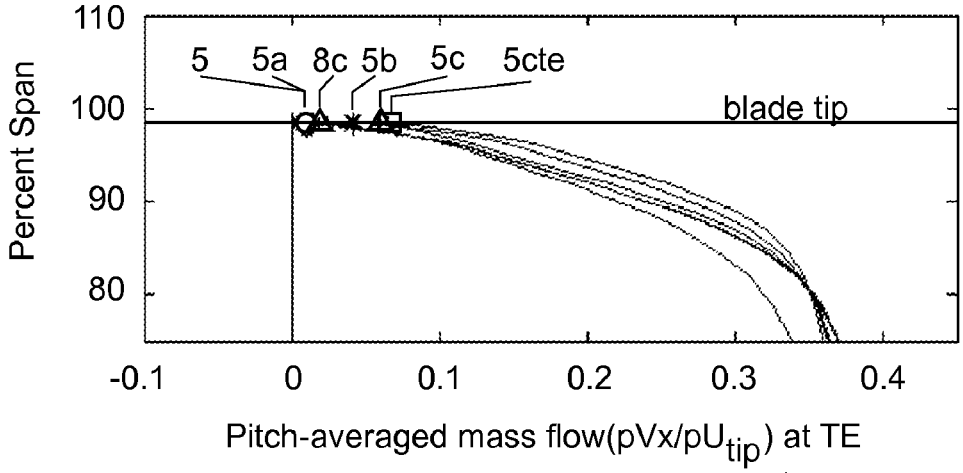
Figure 13A:
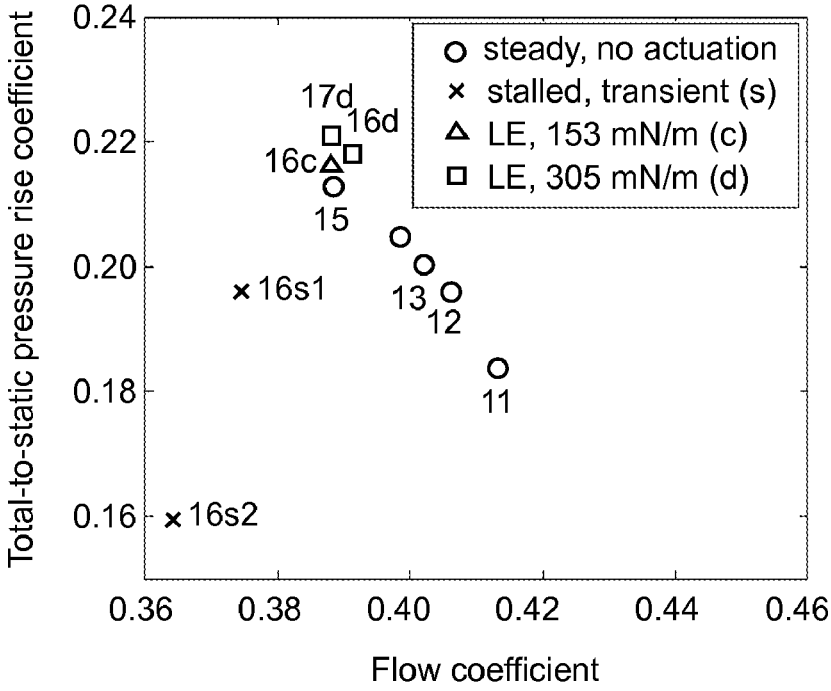
Figure 13B:
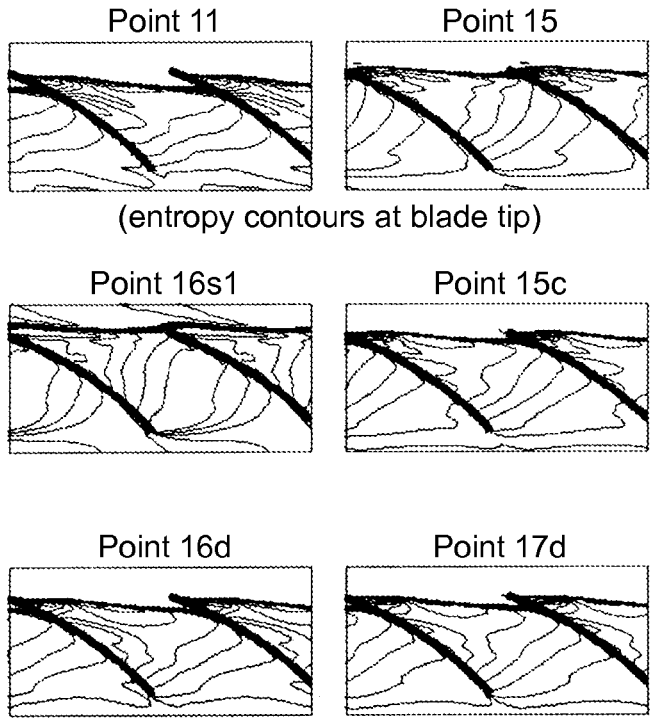
Figure 13C:
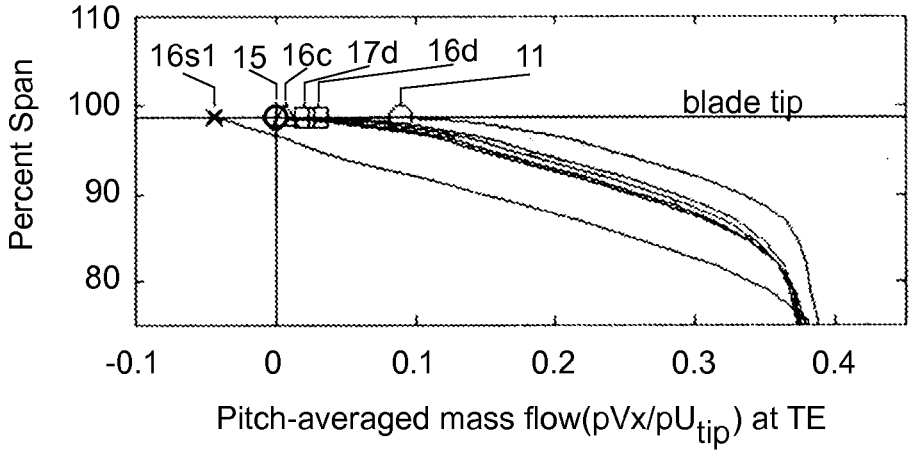

The results from the CFD simulations are presented in FIGS. 11*a* though 13*c* in a common form. Each of FIGS. 11*a*, 12*a* and 13*a* shows the compressor stagnation-to-static pressure rise characteristic (speedline), from 25% axial chord upstream of the rotor LE plane (upstream of the plasma actuator) to 6% axial chord downstream of the rotor TE plane. The rotor tip circumferential velocity ($U_{tip}$) is used as the reference speed for the pressure rise and flow coefficients. The symbols and names associated with the points are consistent throughout all the figures. The number in each point name corresponds to a particular exit tip static pressure setting and the remaining suffix is explained in the legend. Each of FIGS. 11*b*, 12*b* and 13*b*, shows the entropy contour at the blade tip radial plane for selected points to track the incoming/tip clearance flow interface trajectory. This interface is seen as a region of high entropy gradient (see FIG. 11*b*) between the low-entropy incoming and high-entropy tip clearance fluids. The intersection of this interface with the blade tip LE pressure side marks the onset of tip clearance flow spillage below the LE blade tip (spike formation criterion 1). Finally, each of FIGS. 11*c*, 12*c* and 13*c* gives the span-wise distribution of non-dimensional pitch-averaged mass flow (essentially a pitch-averaged flow coefficient involving also density) at the rotor trailing edge plane. The value of this parameter at the blade tip is marked with the symbol associated with each point. A value of zero at the tip (intersection with the vertical line) marks the onset of backflow below the TE blade tip (spike formation criterion 2). A negative value indicates TE backflow.

FIG. 11 presents the simulation results for the $E^3$ rotor B at design speed without actuation. Points 1 through 5 are steady (converged) stable operating points. A small increase in exit tip static pressure of 1.8% of dynamic head (based on rotor tip speed, $U_{tip}$) beyond that of point 5 results in the stall transient along which lie points 6*s*1 and 6*s*2. Thus, point 5 is the closest point to the equilibrium flow limit. FIG. 11*b* shows that the incoming/tip clearance flow interface trajectory has reached the rotor LE pressure surface (trajectory parallel to LE plane) at point 5. FIG. 11*c* indicates that the onset of tip clearance backflow, i.e. the fulfillment of the complementary spike formation criterion, occurs at a flow coefficient just below that of point 5. Beyond the equilibrium flow limit, such as for point 6*s*1, FIGS. 11*b* and 11*c* shows, respectively, that the incoming/tip clearance flow interface has spilled ahead of the LE plane and that backflow has occurred below the TE blade tip. Thus, the equilibrium flow limit is the predicted spike stall inception point. This is further reinforced by the negative slope of the stagnation-to-static speedline at point 5 in FIG. 11*a*.

FIG. 12 shows the effect of flow actuation at design speed. Actuation near the leading edge with axial induced body forces of 15, 76 and 153 mN/m applied with the exit pressure setting of point 5 are represented by points 5*a*, 5*b* and 5*c*, respectively. The results show that an induced body force of 15 mN/m has virtually no effect on the pressure rise, nor on the two spike formation criteria. This implies that the effectiveness of this level of actuator strength is negligible. However, increasing the actuation strength by five times to 76 mN/m (point 5*b*) leads to is a positive jump in pressure rise of 2.8% (FIG. 12*a*) with a noticeable downstream movement of the incoming/tip clearance flow interface and a significant increase in pitch-averaged mass flow at the trailing edge blade tip (i.e. delay of TE backflow) according to FIGS. 12*b* and 12*c*. The increase in pitch-averaged mass flow in the TE tip region also indicates a reduction in tip blockage. Furthermore, the location and extent of the body force region shown in FIG. 10*b* points to the induced flow acceleration being radially confined to the tip clearance gap and should thus not reduce the blade tip incidence. (Since this rotor geometry does not exhibit blade boundary layer separation in the tip region near stall, reducing incidence would have a negative effect on blade tip loading and thus pressure rise). These two factors should explain the observed increase in pressure rise, which bodes well for performance and for suppressing modal stall inception as will be discussed later. Doubling the actuation strength to 153 mN/m (point 5*c*) brings the increase in pressure rise to 4.4%, but has even more significant effect on the incoming/tip clearance flow interface, while further increasing the pitch-averaged mass flow at the trailing edge blade tip.

As expected, applying the same actuation strength of 153 mN/m near the trailing edge (point 5*cte*) does very little to the incoming/leading edge interface and solely increases tip trailing edge mass flow. The associated reduction in tip blockage is responsible for an increase in pressure rise of about 2.8%. However, applying the same actuation at the leading edge (point 5*c*) has about the same effect at the trailing edge while also moving the incoming/tip clearance flow interface downstream to a position near that corresponding the low-loading point 1, as well as giving a superior pressure rise increase. This indicates that the actuator location near the leading edge is more optimal.

With 153 mN/m actuation near the leading edge, the exit pressure is increased beyond the nominal stall value associated with points 6*s*1 and 6*s*2 to obtain equilibrium flow solution at points 6*c*, 7*c* and 8*c* by delaying the onset of the two spike formation threshold events as shown FIGS. 12*b* and 12*c*. As the flow is reduced from point 5*c* to 8*c*, the incoming/tip clearance flow interface moves toward the leading edge and the trailing edge tip mass flow moves toward zero, as expected, and spike stall inception should eventually occur. However, point 8*c*, which is at 6.7% below the nominal stall mass flow (point 5) does not represent a spike formation point but is an artificial limit due to fact that the exit static boundary conditions used in this CFD code cannot capture converged solutions much past the point with exit static pressure turnover (around point 7*c* in this case). (In this case, the static pressure variation along the long downstream duct allowed for the simulations to get converged solutions slightly past the zero-slope peak.)

The above results show that even at the optimum location and for a low compressor tip speed of Mach 0.2, actuator strengths that are several times above those of conventional plasma actuator strength may be needed to have a significant impact on suppressing spike stall inception and a positive impact on pressure rise FIG. 13 shows the results for the simulations of the $E^3$ rotor B at an increased tip speed of Mach 0.5, which should be closer to the operating speeds of most subsonic compressors. Points 11 through 15 are steady (converged) stable operating points. Points 16*s*1 and 16*s*2 lie on a stall transient that occurs following an increase in exit tip static pressure of 0.3% of dynamic head (based on $U_{tip}$) beyond that of point 15. Hence, point 15 is the closest point to the equilibrium flow limit in this case, with both spike formation criteria about to be satisfied at this point according to FIGS. 13*b* and 13*c*. As in the low-speed case, beyond the equilibrium solution limit, the data for point 16*s*1 show that the incoming/tip clearance flow interface has spilled ahead of the LE plane and that backflow has occurred below the TE blade tip.

Actuation at 7% axial chord upstream of the leading edge is then simulated with actuator strengths of 76, 153 and 305 mN/m, this time at an exit pressure corresponding to the stalled points 16*s*1 and 16*s*2. The actuator strength of 76 mN/m (result not shown) could not prevent stall. Compared to the low speed case (FIG. 12, point 5*c*), FIG. 13 shows that the 153 mN/m actuation (point 16*c*) has a significant reduction in effectiveness in terms of pressure rise increase (only about 1-1.5%) and of the incoming/tip clearance flow interface and trailing edge blade tip mass flow. A doubling of the actuation strength to 305 mN/m (point 16*d*) is required to achieve similar (but still lower) effectiveness than achieved with 153 mN/m at the lower speed case. With this actuation, the exit pressure can be increased to further extend the speedline to point 17*d* and beyond (as shown by the remaining margin in terms of the spike formation criteria assessment in FIGS. 13*b* and 13*c* at point 17*d*).

Although it needs to be confirmed with further studies, these preliminary results suggest that for increasing rotor speed, the required actuation strength needs to be multiplied roughly by about the same ratio as the rotor speed.

The results from the simulations carried out according to the above embodiments, have important practical implications in term of the application of the proposed plasma actuation concept for stall suppression in aircraft gas turbine engines.

First, the results indicate that time-averaged axial induced body forces on the order of $10^2$ N/m will be required to achieve the desired effects of stall margin improvement as well as pressure rise increase, especially at realistic compressor speeds. Although this is an order of magnitude higher than the actuation strength of traditional SDBD plasma actuators based on what has been published in the literature, these body forces levels can be achieved in principle by increasing the applied voltage and frequency beyond the traditional range of 1-10 kV amplitude and 1-10 kHz frequency and by modifications to the actuator geometry, dielectric material and the shape of the input signal.

Second, although the results point to the leading edge region as the best location for a casing plasma actuator, the exact position may depend on the compressor, and CFD simulations may provide an inexpensive tool to find it. Based on the physics, one can deduce that there should be an optimum actuator location with respect to the leading edge. If it is placed too far upstream of the leading edge, the flow acceleration effect at the leading edge plane is reduced. Moreover, the increase in radial extent of the flow acceleration region will reduce tip incidence and likely the tip blade loading. Although it is conceivable that the resulting reduced momentum of the tip clearance flow would be beneficial in terms of delaying the spike formation criteria and thus delay the stall point, the reduction in pressure rise may not be desirable and may neutralize one major advantage that this type of actuation has over casing treatment, i.e. avoid the trade-off between performance and stability. On the other hand, while placing the actuator downstream of the leading edge would insure that the actuation does not affect the blade tip incidence, the exposed electrode may be damaged should the rotor tip rub the casing, which could likely happen over the operational life of the engine. Moreover, the influence of the actuation on the incoming leading edge interface diminishes with increasing actuator distance downstream of the leading edge.

Figure 16:
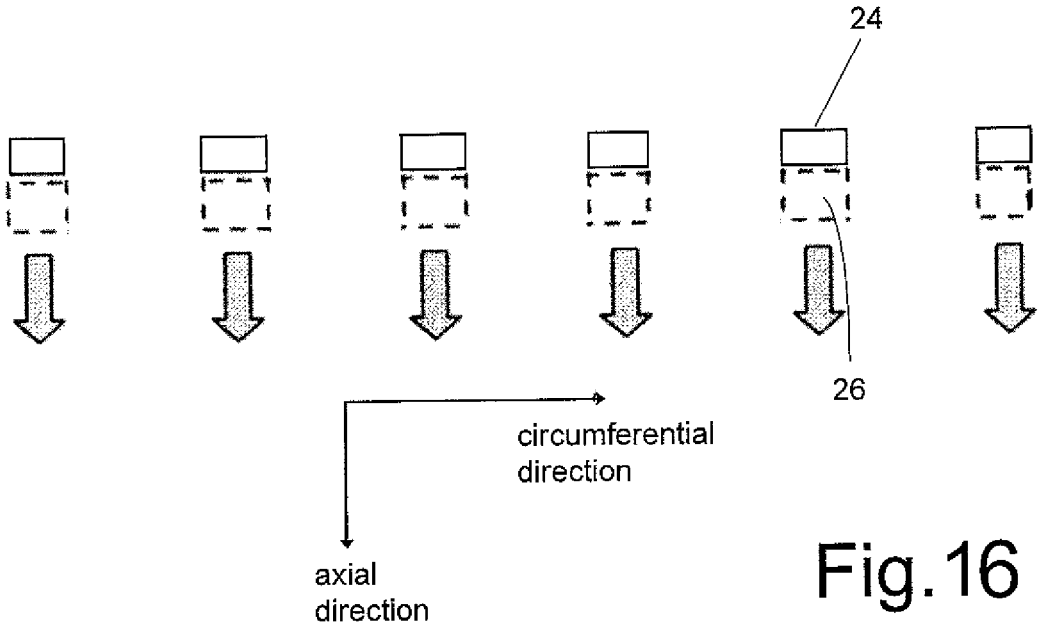
FIG. 16 is a schematic illustration of a divided plasma actuator having discrete independent plasma actuator sections discontinuously provided around the casing inner surface for spike stall suppression in a circumferentially extending view.

Third, although suppressed in one rotor of a multi-stage compressor, spike disturbances may occur in another rotor at a lower flow coefficient. Thus, there may be a need to apply this concept to multiple rotors in a multi-stage compressor. In this case, power consumption is one consideration. For the proposed plasma actuation, the power imparted to the flow for the full annulus (computed from the induced body force and the velocity integrated over all cells in the CFD domain) is on the order of 10 W for 153 mN/m actuation strength at the design rotor tip speed of Mach 0.2 and 45 W for 305 mN/m actuation at a rotor tip speed of Mach 0.5. Even if one were to account for the sources of loss associated with plasma actuators, the required power levels would still be several orders of magnitude below that needed to drive a compressor. In addition, should power requirements become a concern at higher speeds, one solution would be to apply an optimized on/off (i.e. intermittent) duty cycle to the input so as to excite the turbulent flow structures in the casing boundary layer to obtain momentum transfer from the outer higher-velocity region of the boundary layer rather than from the plasma actuator alone. Alternatively, past successful suppression of spike stall inception using only a few discrete micro air injectors around the annulus and directed at the blade tip region implies that a few discrete plasma actuators of limited circumferential extent placed around the annulus and operating in continuous (non pulsed) mode may be able to delay spike stall inception while consuming less power than a full annular plasma actuator. Such an example is illustrated in FIG. 16, wherein the plasma actuator comprises a plurality of discrete independent plasma actuator sections of limited circumferential extent, provided discontinuously around the casing inner surface (in the circumferential direction). Another consideration is geometrical constraint. Due to the limited distance between blade rows, one can not use multiple actuators in series, which further highlights the importance of fabricating actuators with high induced body forces.

Figure 14:
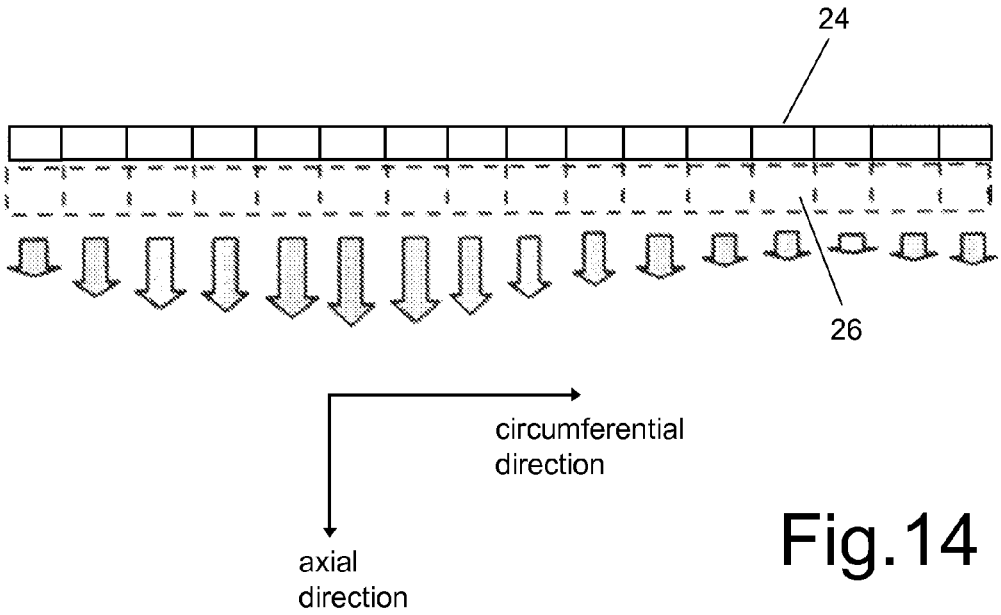
FIG. 14 is a schematic illustration of a divided annular plasma actuator used for modal stall suppression, in a circumferentially extending view.

Last but not least, it is noted that modal stall inception will eventually occur once spike stall inception is suppressed and the extended speedline reaches the zero-slope peak, as shown for the 153 mN/m actuation case in FIG. 12*a*. Thus, a proposed plasma actuation scheme may need to be able to suppress modal stall inception as well. As mentioned earlier, the simulated effects of the proposed plasma actuation on the speedline opens the door for its use to suppress modal stall inception. Indeed, the observed increase in pressure rise on the order of 5% (FIG. 12*a*) is in line with that of the jet actuators successfully used in experiments to suppress modal stall inception. The simulations results also indicate that if needed, this value can be enhanced with increased actuator strength. As shown in FIG. 14, the proposed actuator can be spilt into multiple independent adjacent sections (i.e. discrete actuators) of equal circumferential extent to be able to introduce circumferential perturbations in pressure rise.

The introduction of circumferential perturbations in pressure rise to suppress modal stall inception can be achieved by a plurality of discrete actuators of any type which add momentum to the airflow at the blade tips, including mechanical actuators which inject airflows. However, since SDBD plasma actuators are relatively simple, the number of circumferentially adjacent sections can be made high enough, such as 8 to 16 or even more discrete actuators depending on the particular engine, to produce purer sinusoidal circumferential perturbations and up to higher spatial harmonics (to control higher modes that usually grow at lower flow coefficients and thus obtain more stall margin) than possible with a limited number of conventional discrete mechanical actuators.

Figure 15:
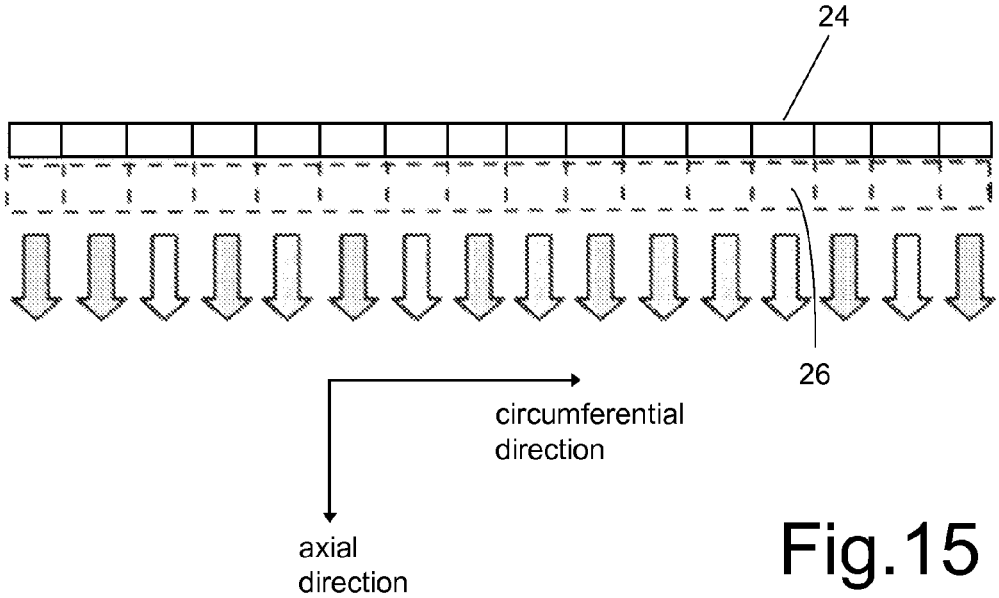
FIG. 15 is a schematic illustration of a divided annular plasma actuator used for spike stall suppression, in a circumferentially extending view.

At the same time, these plasma actuator sections acting in unison may be used as a single plasma actuator as shown in FIG. 15, to suppress spike stall inception. Another advantage of plasma actuators for modal stall suppression is that being electrical devices, they should have higher bandwidths than mechanical actuators.

A concept for the suppression of spike stall inception with SDBD plasma actuators is therefore provided based on the above-computational simulation. It comprises placing a circumferential plasma actuator on the casing near the compressor rotor to induce axial flow acceleration within the tip clearance gap region to suppress the tip clearance flow features responsible for spike formation and short length-scale rotating stall inception. In addition, the plasma actuation alters the pressure rise enough, through tip blockage reduction, to be used for suppression of modal stall inception. The concept may increase stall margin without affecting the performance of the compressor. Although the required total induced body force, especially for the higher subsonic speeds, is an order of magnitude higher than that the traditional plasma actuator in the prior art, it may not be beyond what can be achieved with improved actuator design and input. The optimum location of the actuator should be very close to the leading edge and should be able to suppress the two criteria for spike stall inception with minimal power consumption. At the same time, limiting the actuation region to within the tip clearance gap should result in an increase of compressor pressure rise, thus not only improving performance, but allow a modification of the actuator to suppress modal stall inception as well.

This concept shows very high potential for significantly improving compressor stall margin and performance with a relatively simple actuator with no moving parts. There are ongoing improvements in plasma actuator design to increase robustness and actuation strength. Furthermore, lighter and more powerful power generators for plasma actuators aimed at aerospace applications are becoming commercially available. In general, any plasma actuator which adds momentum to the flow near the surface of the actuators can be employed in this concept.

The above description is meant to be exemplary only, and one skilled in the art will recognize that changes may be made to the embodiments described without departing from the scope of the invention disclosed. For example, the axial location of the plasma actuator described in the above embodiment is axially upstream of the leading edges of the blade tips of the rotor assembly, advantageously avoiding damage thereto caused by blade tip rubbing against the compressor casing. However, in other embodiments, it may be desirable to dispose the plasma actuator substantially coincident with the vertical plane defined by the leading edges of the blade tips of the rotor assembly, or desirable to dispose the plasma actuator axially downstream of the leading edges of the blade tips and upstream of the trailing edges of the blade tips of the rotor assembly. Still other modifications will be apparent to those skilled in the art, in light of a review of this disclosure, and such modifications are intended to fall within the appended claims.

The invention claimed is:

1. A method of using a plasma actuator for suppressing rotating stall inception of a compressor, the compressor including a casing having an inner surface surrounding a rotor assembly, the rotor assembly having a plurality of circumferentially spaced radially outwardly extending rotor blades, each blade having leading and trailing edges and a tip, the plasma actuator including a plurality of discrete independent circumferentially adjacent plasma actuator sections provided circumferentially around the casing near the blade tips of the rotor assembly, the method comprising:

a) actuating the independent circumferentially adjacent plasma actuator sections in a substantially circumferentially uniform manner to suppress tip clearance flow features responsible for spike rotating stall inception; and then b) actuating the independent circumferentially adjacent plasma actuator sections in a substantially sinusoidal manner to introduce a substantially sinusoidal circumferential perturbation in pressure rise around the compressor to suppress modal stall inception.

2. The method of claim 1 wherein step (b) begins when the spike rotating stall inception is substantially suppressed and a zero-slope peak of stagnation-to-static pressure rise characteristics of the compressor is reached.

3. The method of claim 1 wherein step (a) comprises applying input in an intermittent duty cycle to the plasma actuator sections so as to excite turbulent flow structures in the casing boundary layer to obtain momentum transfer from an outer higher velocity region of the boundary layer.

4. A method of using a plasma actuator for suppressing rotating stall inception of a compressor, the compressor including a casing having an inner surface surrounding a rotor assembly, the rotor assembly having a plurality of circumferentially spaced radially outwardly extending rotor blades, each blade having leading and trailing edges and a tip, the plasma actuator including independent circumferentially adjacent plasma actuator sections provided circumferentially around the casing near the blade tips of the rotor assembly, the method comprising actuating the respective plasma actuator sections in a circumferential sequence to induce circumferentially varying axial flow acceleration within a tip clearance gap region of the rotor assembly, thereby resulting in a circumferential perturbation in pressure rise around the compressor.

5. The method as defined in claim 4 wherein the circumferential perturbation in pressure rise around the compressor is in a substantially sinusoidal pattern.

* * * * *